US010280748B2

(12) United States Patent
Tang

(10) Patent No.: US 10,280,748 B2
(45) Date of Patent: May 7, 2019

(54) HIGH-FREQUENCY VIBRATING TRANSVERSE DRUM CUTTER HEAD, AND DRUM CUTTER MACHINE AND TUNNEL BORING MACHINE THEREWITH

(71) Applicant: Zhongsheng Tang, Nanning (CN)

(72) Inventor: Zhongsheng Tang, Nanning (CN)

(73) Assignee: Zhongsheng Tang, Guangxi Autonomous Region (CN)

( * ) Notice: Subject to any disclaimer, the term of this patent is extended or adjusted under 35 U.S.C. 154(b) by 103 days.

(21) Appl. No.: 15/329,314

(22) PCT Filed: Aug. 3, 2015

(86) PCT No.: PCT/CN2015/000535
§ 371 (c)(1),
(2) Date: Jan. 26, 2017

(87) PCT Pub. No.: WO2016/201591
PCT Pub. Date: Dec. 22, 2016

(65) Prior Publication Data

US 2017/0211384 A1 Jul. 27, 2017

(30) Foreign Application Priority Data

Jun. 17, 2015 (CN) ..... 2015 1 0337224

(51) Int. Cl.
*E21D 9/10* (2006.01)
*E02F 3/18* (2006.01)
*E21C 27/24* (2006.01)

(52) U.S. Cl.
CPC ..... *E21D 9/1046* (2013.01); *E02F 3/181* (2013.01); *E02F 3/188* (2013.01); *E21C 27/24* (2013.01);

(Continued)

(58) Field of Classification Search
CPC ..... E21D 9/1046; E21D 9/106; E21D 9/1026; E21D 9/1033; E21D 9/102; E21C 25/02; E21C 27/28; E21C 27/46; E21C 27/24
See application file for complete search history.

(56) References Cited

U.S. PATENT DOCUMENTS 4,030,566 A * 6/1977 Cobb ..... B28D 1/26 184/6.13
4,377,311 A * 3/1983 Seller ..... E21D 9/102 299/64

(Continued)

FOREIGN PATENT DOCUMENTS

CN 2426014 Y 4/2001
CN 2560756 Y 7/2003

(Continued)

OTHER PUBLICATIONS

Search Report & First Office Action for related Chinese Application No. 201510337224.6.

(Continued)

*Primary Examiner* — David J Bagnell
*Assistant Examiner* — Michael A Goodwin
(74) *Attorney, Agent, or Firm* — Miller, Matthias & Hull LLP

(57) ABSTRACT

A high-frequency vibrating transverse drum cutter head, and a drum cutter machine and a tunnel boring machine with such drum cutter head are disclosed. The transverse drum cutter wheel of the high-frequency vibrating transverse drum cutter head is driven by the cutting motor to rotate, the transverse drum cutter wheel is provided with cutting teeth, the transverse drum cutter wheel is mounted on one end of the drum cutter head base, the other end of the drum cutter head base is connected to a U-shaped drum cutter mechanism body, a connecting base is mounted on the U-shaped drum cutter mechanism body and used for mounting the (Continued)

high-frequency vibrating transverse drum cutter head on a drum cutter machine or a tunnel boring machine, a vibration box is mounted on the drum cutter head base, and the vibration box is adapted to output high-frequency vibration force to the transverse drum cutter wheel through the drum cutter head base, so that the transverse drum cutter wheel 16 is able to perform high-speed repetitive vibrating movement while achieving its own rotation. Both rotation motion and high frequency repetitive vibration can be implemented at the same time by the present invention, through the combination of the transverse drum cutter wheel and the vibration box, making the cutting teeth on the drum cutter wheel apply combined action of impacting and cutting on the contacted materials.

6 Claims, 2 Drawing Sheets

(52) U.S. Cl.
CPC ..... *E21D 9/102* (2013.01); *E21D 9/1013* (2013.01); *E21D 9/1026* (2013.01)

(56) References Cited

U.S. PATENT DOCUMENTS 4,470,635 A * 9/1984 Paurat ..... E21D 9/102 173/4
6,158,818 A * 12/2000 Schaeff ..... E02F 3/205 299/78
9,932,826 B2 * 4/2018 Krings ..... E21C 25/08
2001/0002974 A1 * 6/2001 Dimillo ..... E02F 9/024 414/565
2011/0198914 A1 * 8/2011 Hartwig ..... E21C 27/24 299/18
2014/0077578 A1 * 3/2014 Smith ..... E21C 25/06 299/1.4
2014/0091612 A1 * 4/2014 Rowher ..... E21C 27/24 299/10
2017/0268336 A1 * 9/2017 Yoon ..... E02F 3/78

FOREIGN PATENT DOCUMENTS

CN 201459789 U 5/2010
CN 102409974 A 4/2012
CN 102797459 A 11/2012
CN 202788838 U 3/2013
CN 204002778 U 12/2014
CN 104847361 A 8/2015
CN 204703913 U 10/2015
JP H 08326481 A 12/1996
JP 2003074287 A 3/2003
WO WO 9722424 A 6/1997

OTHER PUBLICATIONS

Supplementary Search Report & Second Office Action for related Chinese Application No. 201510337224.6.
International Search Report Application No. PCT/CN2015/000535 dated Apr. 1, 2016.

* cited by examiner

HIGH-FREQUENCY VIBRATING TRANSVERSE DRUM CUTTER HEAD, AND DRUM CUTTER MACHINE AND TUNNEL BORING MACHINE THEREWITH

CROSS-REFERENCE TO RELATED APPLICATION

This patent application is a 35 USC § 371 U.S. national stage of International Application No. PCT/CN2015/000535 filed on Aug. 3, 2015, which claims priority under the Paris Convention to the Chinese Patent Application No. CN 201510337224.6 filed on Jun. 17, 2015.

FIELD OF THE DISCLOSURE

The present disclosure relates generally to the technical field of construction machinery, and specifically to a high-frequency vibrating transverse drum cutter head, and a drum cutter machine and a tunnel boring machine with such drum cutter head.

BACKGROUND OF THE DISCLOSURE

The drum cutter machine is a hydraulic appurtenance supporting the use of an excavator, which can be widely used for construction, such as tunnel, channel, engineering construction, and rock excavation, with advantages of high efficiency, accuracy and low cost. According to different arrangements of the drum cutter head, the drum cutter machine can be divided into two basic categories: transverse drum cutter machine and longitudinal drum cutter machine. Drum cutter machines of various sizes have been used in many countries in the prior art. The tunnel boring machine is a kind of construction equipment similarly to a drum cutter machine mounted on a special chassis, which combines functions of cutting, loading, travelling and operation, and is mainly used to cut down-hole rock, coal-rock drift or mixed coal-rock drift, each with cross-sections of arbitrary shapes. Both of the drum cutter machine and the tunnel boring machine may work like this: the drum cutter head may be driven by a hydraulic motor through a transmission mechanism to rotate, so that cutting teeth mounting on the drum cutter head can cut the contacted materials and thus strip away the materials, to achieve the purpose of drilling and digging. An electric motor may be further used to drive the drum cutter head in the tunnel boring machine. Both of the drum cutter machine and the tunnel boring machine in the prior art may be generally suitable for rock formations or minerals with relatively low hardness, and they may be not able to work or in low efficiency when encountering rock formations with relatively high hardness, with great spoilage of cutting teeth, so their application sites receive restriction.

SUMMARY OF THE DISCLOSURE

A technical problem to be solved by the present disclosure is to provide a high-frequency vibrating transverse drum cutter head, and a drum cutter machine and a tunnel boring machine with such drum cutter head, a drum cutter wheel of which can perform high frequency repetitive vibration while doing rotation movement, making the cutting teeth on the drum cutter wheel apply combined action of impacting and cutting on the contacted materials, so as to break hard rock easily.

The above technical problem can be solved by the following technical solutions.

A high-frequency vibrating transverse drum cutter head is provided, including a transverse drum cutter wheel 16, a drum cutter head base 12, and a cutting motor 4, wherein the transverse drum cutter wheel 16 is driven by the cutting motor 4 to rotate, the transverse drum cutter wheel 16 is provided with cutting teeth 1, the transverse drum cutter wheel 16 is mounted on one end of the drum cutter head base 12, the other end of the drum cutter head base 12 is connected to a U-shaped drum cutter mechanism body 10, a connecting base 7 is mounted on the U-shaped drum cutter mechanism body 10 and used for mounting the high-frequency vibrating transverse drum cutter head on a drum cutter machine or a tunnel boring machine, a vibration box 5 is mounted on the drum cutter head base 12, and the vibration box 5 is adapted to output high-frequency vibration force to the transverse drum cutter wheel 16 through the drum cutter head base 12, so that the transverse drum cutter wheel 16 is able to perform high-speed repetitive vibrating movement while achieving its own rotation.

An upper air spring 8-2 which is compressible by the U-shaped drum cutter mechanism body 10 is arranged at the top of the vibration box 5, and a lower air spring 8-1 which is compressible by the drum cutter head base 12, and a first vibration reduction rubber 14 are arranged on the lower part of the U-shaped drum cutter mechanism body 10.

The middle part of the U-shaped drum cutter mechanism body 10 is connected to the drum cutter head base 12 through a connection bearing 13, or alternatively, a lateral side of the U-shaped drum cutter mechanism body 10 is provided with a strengthening rib 33, the drum cutter head base 12 is connected to the strengthening rib 33 through a lateral vibration reduction rubber 27 to achieve sliding displacement, and a second vibration reduction rubber 15 is arranged between the drum cutter head base 12 and the U-shaped drum cutter mechanism body 10.

The cutting motor 4 is mounted on the drum cutter head base 12, a driving gear 19 is mounted on an output end of the cutting motor 4, the driving gear 19 is engaged with a transmission gear 18 mounted on the drum cutter head base 12, and the transmission gear 18 is engaged with a driven gear 17 mounted on the axle of the transverse drum cutter wheel 16.

A pivoting support 29 is mounted between the U-shaped drum cutter mechanism body 10 and the connecting base 7, so that the high-frequency vibrating transverse drum cutter head is pivotable about the connecting base 7 for a certain angle.

A drum cutter machine with the high-frequency vibrating transverse drum cutter head according to the present disclosure has the following structure: the high-frequency vibrating transverse drum cutter head is connected to one end of a telescopic driving arm 23 through the connecting base 7, the other end of the driving arm 23 is hinged to a mounting base 2 of an excavator or tunnel boring machine, a telescopic cylinder 22 and a lifting cylinder 25 are mounted on a lateral side and a lower side of the driving arm 3 respectively, one end of each of the telescopic cylinder 22 and the lifting cylinder 25 is hinged to the mounting base 2, and the other end of each of the telescopic cylinder 22 and the lifting cylinder 25 is hinged to the driving arm 23.

A tunnel boring machine with the high-frequency vibrating transverse drum cutter head according to the present disclosure has the following structure: the high-frequency vibrating transverse drum cutter head is connected to one end of a telescopic driving arm 23 through the connecting base 7, the other end of the driving arm 23 is hinged to a mounting base 2 of an excavator or tunnel boring machine, a telescopic cylinder 22 and a lifting cylinder 25 are mounted on a lateral side and a lower side of the driving arm 23 respectively, one end of each of the telescopic cylinder 22 and the lifting cylinder 25 is hinged to the mounting base 2, and the other end of each of the telescopic cylinder 22 and the lifting cylinder 25 is hinged to the driving arm 23; and the mounting base 2 is mounted on one end of a tunnel boring machine chassis 21, a side-shifting mechanism 34 is provided to control the mounting base 2 to swing from side to side, the other end of the tunnel boring machine chassis 21 is provided with a conveying device 20, a collecting device 24 is arranged below the driving arm 23, mounted on the tunnel boring machine chassis 21, and connected to the conveying device 20, and a travelling mechanism 26 is mounted at the bottom of the tunnel boring machine chassis 21.

The high-frequency vibrating transverse drum cutter head according to the present disclosure can perform both rotation motion and high frequency repetitive vibration at the same time, through the combination of the transverse drum cutter wheel and the vibration box, making the cutting teeth on the drum cutter wheel apply combined action of impacting and cutting on the contacted materials, so as to break hard rock easily.

The drum cutter machine or tunnel boring machine fitted with the high-frequency vibrating transverse drum cutter head according to the present disclosure can not only cut the materials with the cutting teeth, but also apply great impact force to break the rock instantaneously. Compared with the prior art, the drum cutter machine or tunnel boring machine according to the present disclosure can excavate various rocks and materials with high hardness, and significantly improve the operating efficiency of rocks and materials with low hardness. Since the rock bodies are broken into pieces mainly by the impact force, the abrasion of the cutting teeth is significantly reduced, with obvious advantages. In addition, such drum cutter machine or tunnel boring machine is suitable for various rocks with medium or high hardness, to improve operating efficiency and reduce the abrasion of the cutting teeth.

DESCRIPTION OF REFERENCE SIGNS

1 cutting tooth, 2 mounting base, 4 cutting motor, 5 vibration box, 6 vibration motor, 7 connecting base, 8-1 upper air spring, 8-2 lower air spring, 10 drum cutter mechanism body, 12 drum cutter head base, 13 connection bearing, 14 first vibration reduction rubber, 15 second vibration reduction rubber, 16 transverse drum cutter wheel, 17 driven gear, 18 transmission gear, 19 driving gear, 20 conveying device, 21 tunnel boring machine chassis, 22 telescopic cylinder, 23 driving arm, 24 collecting device, 25 lifting cylinder, 26 travelling mechanism, 27 lateral vibration reduction rubber, 28 pivoting support motor, 29 pivoting support, 30 left eccentric wheel, 31 right eccentric wheel, 32 meshing gear, 33 strengthening rib and 34 side-shifting mechanism.

DETAILED DESCRIPTION OF THE DISCLOSURE

In the following description of embodiments, reference is made to the accompanying drawings which form a part hereof, and in which it is shown by way of illustration specific embodiments of the disclosure that can be practiced.

First Embodiment

Figure 1:
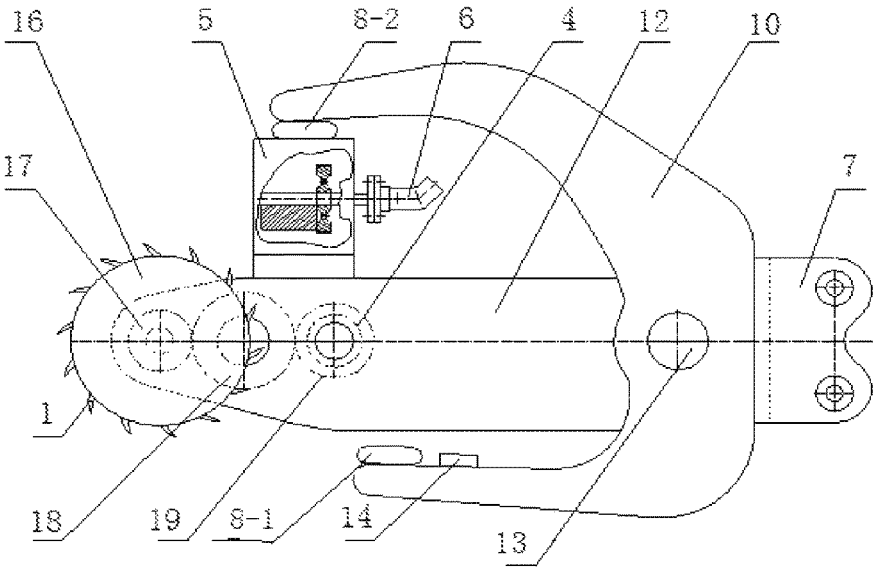
FIG. 1 is a structural schematic diagram illuminating a high-frequency vibrating transverse drum cutter head according to a first embodiment of the present disclosure, in which the drum cutter head base 12 is connected to the drum cutter mechanism body 10 through a connection bearing 13.
Figure 2:
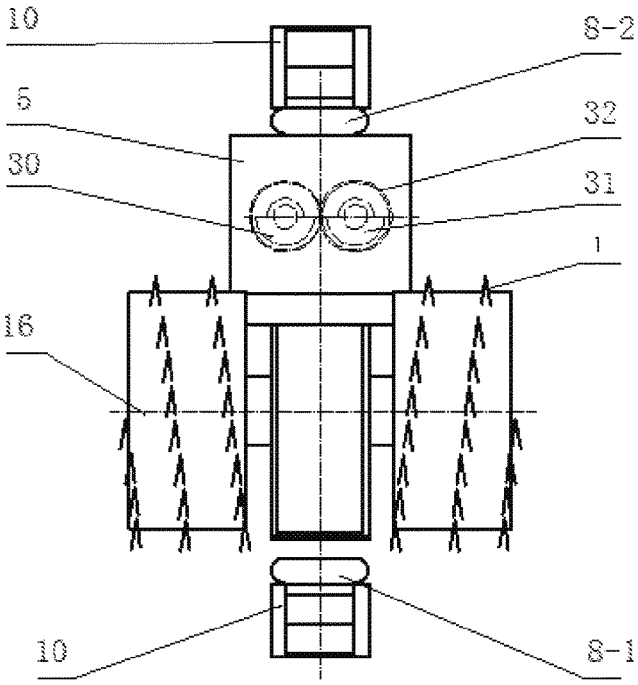
FIG. 2 is a left view of FIG. 1.

As shown in FIGS. 1 and 2, a high-frequency vibrating transverse drum cutter head is provided, including a transverse drum cutter wheel 16, a drum cutter head base 12, a cutting motor 4, a vibration box 5 and a U-shaped drum cutter mechanism body 10. The transverse drum cutter wheel 16 is arranged transversely with respect to the U-shaped drum cutter mechanism body 10, adapted to transversely cut the object to be milled and excavated. The transverse drum cutter wheel 16 is driven by the cutting motor 4 to rotate. The cutting motor 4 is mounted on the drum cutter head base 12. A driving gear 19 is mounted on the output end of the cutting motor 4. The driving gear 19 is engaged with a transmission gear 18 mounted on the drum cutter head base 12. The transmission gear 18 is engaged with a driven gear 17 mounted on the axle of the transverse drum cutter wheel 16. The driving gear 19, transmission gear 18 and the driven gear 17 are arranged side by side. The transverse drum cutter wheel 16 is provided with cutting teeth 1. The transverse drum cutter wheel 16 is mounted on one end of the drum cutter head base 12, and the other end of the drum cutter head base 12 is connected to the middle part of the U-shaped drum cutter mechanism body 10 through a connection bearing 13, so that the drum cutter head base 12 may pivot about the connection bearing 13 for a certain angle. A connecting base 7 is mounted on the U-shaped drum cutter mechanism body 10 and used for mounting the high-frequency vibrating transverse drum cutter head on a drum cutter machine or a tunnel boring machine. The connecting base 7 may be connected to a bucket pin of an excavator. The vibration box 5 is mounted on the drum cutter head base 12. An upper air spring 8-2 which is compressible by the U-shaped drum cutter mechanism body 10 is arranged at the top of the vibration box 5, and a lower air spring 8-1 which is compressible by the drum cutter head base 12, and a first vibration reduction rubber 14 are arranged on the lower part of the U-shaped drum cutter mechanism body 10. Any appropriate vibration box in the prior art may be used as the vibration box 5.

In this embodiment, the vibration box 5 has a left eccentric wheel 30 and a right eccentric wheel 31 arranged in pair. Meshing gears 32 mounted on rotation shafts of the left eccentric wheel 30 and the right eccentric wheel 31 respectively are exactly the same. The rotation shaft of one eccentric wheel is driven by the vibration motor 6 to rotate, making the eccentric wheel in pair move relative to one another through the meshing gears 32, so that the vibration box 5 output high frequency vibration force on the drum cutter head base 12. In this way, the transverse drum cutter wheel 16 is able to perform high-speed repetitive vibrating movement while achieving its own rotation.

When working, the cutting motor 4 may be activated to drive the driving gear 19 to rotate, and the transmission gear 18 engaged with the driving gear 19, and the driven gear 17 engaged with the transmission gear 18 are further driven to rotate, so the transverse drum cutter wheel 16 coaxial with the driven gear may be driven to rotate. Then the vibration motor 6 may be activated to drive the rotation shafts of the eccentric wheels to rotate. The two rotation shafts make in-phase rotations with respect to each other through exactly same meshing gears, so as to bring the left eccentric wheel 30 and the right eccentric wheel 31 which are exactly the same into in-phase rotation movements. In this way, the eccentric three of the vibration box in the horizontal direction may be offset, while the eccentric force of the vibration box in the vertical direction may be superposed, so the vibration box may output repetitive vibration force in the vertical direction on the drum cutter head base 12, to drive the transverse drum cutter wheel 16 to make repetitive vibration movement. Since the other end of the drum cutter head base 12 is connected to the U-shaped drum cutter mechanism body 10 through the connection bearing 13, the repetitive movement of the transverse drum cutter wheel 16 may make a circle with the center of the connection bearing 13, with a vibration frequency depending on the rotation speed of the vibration motor 6.

When the drum cutter head base 12 is driven by the vibration box 5 to make high speed repetitive movement, the position of the top of the vibration box 5 moving upwards may be restrained by the upper air spring 8-2, and meanwhile, the upper air spring 8 may store the upward vibration force and the counter force of the material to be cut applying on the transverse drum cutter wheel 16, and these forces may be released during the downward movement, so the cutting teeth may have greater impact force on the material. A lower air spring 8-1 and a first vibration reduction rubber 14 are arranged between the drum cutter head base 12 and the U-shaped drum cutter mechanism body 10.

Second Embodiment

Figure 3:
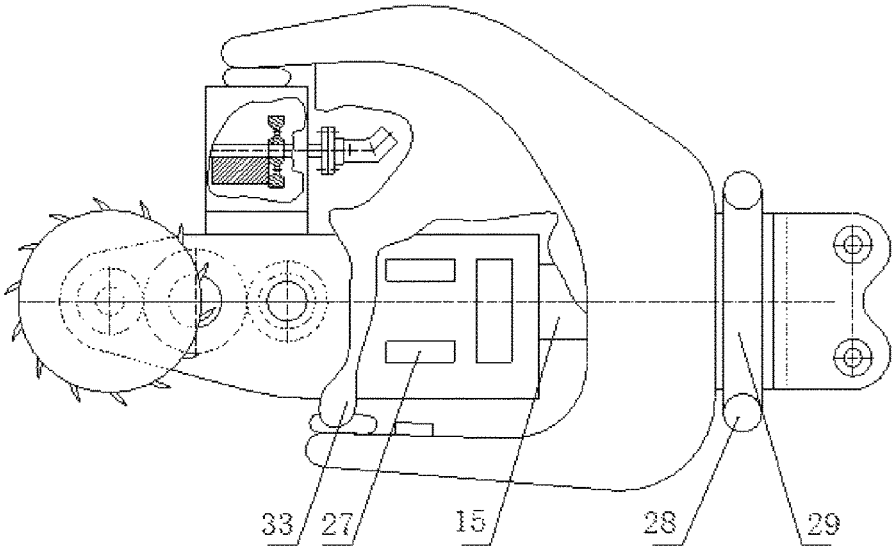
FIG. 3 is a structural schematic diagram illuminating a high-frequency vibrating transverse drum cutter head according to a second embodiment of the present disclosure, in which the drum cutter head base 12 is connected to the drum cutter mechanism body 10 through a lateral vibration reduction rubber 27.

As shown in FIG. 3, the configuration of the high-frequency vibrating transverse drum cutter head in this embodiment is almost the same as that in the first embodiment, except that the U-shaped drum cutter mechanism body 10 is not connected to the drum cutter head base 12 through the bearing, but a lateral vibration reduction rubber 27. The drum cutter head base 12 may be connected to the mechanism body 10 through a plurality of lateral vibration reduction rubbers, with a certain range of motion. As shown in FIG. 3, a lateral side of the U-shaped drum cutter mechanism body 10 is provided with a strengthening rib 33, the drum cutter head base 12 is connected to the strengthening rib 33 through a lateral vibration reduction rubber 27, and a second vibration reduction rubber 15 is arranged between the drum cutter head base 12 and the U-shaped drum cutter mechanism body 10. The second vibration reduction rubber 15 may have a function of vibration reduction for the U-shaped drum cutter mechanism body 10, while restricting the displacement of the drum cutter head base 12 to the right.

In order to facilitate the operations of the high-frequency vibrating transverse drum cutter head according to the present disclosure for objects with different angles, a pivoting support 29 may be arranged between the U-shaped drum cutter mechanism body 10 and the connecting base 7. The base of the pivoting support 29 is fixedly connected to the connecting base 7, and the rotation part is fixedly connected to the U-shaped drum cutter mechanism body 10, so that the high-frequency vibrating transverse drum cutter head may pivot about the connecting base 7 for a certain angle.

Figure 4:
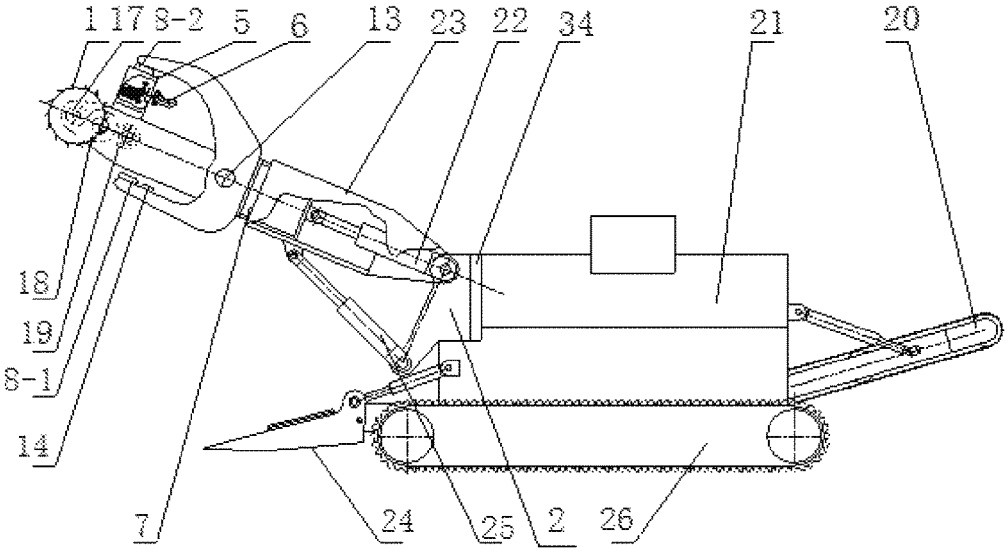
FIG. 4 is a schematic diagram illuminating a drum cutter machine with the high-frequency vibrating transverse drum cutter head of FIG. 1 and a tunnel boring machine therewith.

As shown in FIG. 4, the high-frequency vibrating transverse drum cutter head according to the present disclosure may be used in a drum cutter machine or tunnel boring machine. The drum cutter machine according to the present disclosure is an appurtenance supporting the use of the excavator, which has the following structure: the high-frequency vibrating transverse drum cutter head of the first embodiment is connected to one end of a telescopic driving arm 23 through the connecting base 7, the other end of the driving arm 23 is hinged to a mounting base 2 of an excavator or tunnel boring machine, a telescopic cylinder 22 and a lifting cylinder 25 are mounted on a lateral side and a lower side of the driving arm 3 respectively, one end of each of the telescopic cylinder 22 and the lifting cylinder 25 is hinged to the mounting base 2, and the other end of each of the telescopic cylinder 22 and the lifting cylinder 25 is hinged to the driving arm 23.

The high-frequency vibrating transverse drum cutter head according to the present disclosure should be connected to the driving arm 23 and then connected to the excavator for working. The location of the bucket may be replaced with the connecting base 7. A hydraulic pipe may be connected to a pipe of the driving device of the present invention. Upon connecting, the U-shaped drum cutter mechanism body 10 may be positioned to a position that needs to be milled and excavated, through the operation of the arms of the excavator.

After the rotation speed and the vibration frequency of the transverse drum cutter wheel 16 are adjusted to appropriate values, the transverse drum cutter wheel 16 may contact the object to be milled and excavated, through controlling the driving arm 23. The cutting teeth 1 may not only cut the object, but also apply vibration impact force on the object, to break the rock instantaneously. The broken materials may be drained out to move out of place through the rotation movement of the drum cutter head 2, to avoid secondary abrasion of the cutting teeth 1.

The transverse drum cutter wheel 16 may be further driven to contact the object to be milled and excavated sequentially through operating the arms of the excavator, to form a sequential construction operation.

The tunnel boring machine according to the present disclosure is shown in FIG. 4, which incorporates a travelling mechanism 26, a tunnel boring machine chassis 21, a collecting device 24 and a conveying device 20, based on the above high-frequency vibrating drum cutter machine. The high-frequency vibrating transverse drum cutter head of the first embodiment is connected to one end of a driving arm 23 through the connecting base 7, the driving arm 23 is in a telescopic structure, the other end of the driving arm 23 is hinged to a mounting base 2, the mounting base 2 is fixed on the excavator, a telescopic cylinder 22 and a lifting cylinder 25 are mounted on a lateral side and a lower side of the driving arm 3 respectively, one end of each of the telescopic cylinder 22 and the lifting cylinder 25 is hinged to the mounting base 2, and the other end of each of the telescopic cylinder 22 and the lifting cylinder 25 is hinged to the driving arm 23; and the mounting base 2 is mounted on one end of the tunnel boring machine chassis 21, a side-shifting mechanism 34 is mounted between the mounting base 2 and the tunnel boring machine chassis 21, and the mounting base 2 is controllable to swing from side to side by the side-shifting mechanism 34, so that the driving arm 23 can perform lateral motion for a certain angle. The other end of the tunnel boring machine chassis 21 is provided with the conveying device 20, a collecting device 24 is arranged below the driving arm 23, mounted on the tunnel boring machine chassis 21, and connected to the conveying device 20, and a travelling mechanism 26 is mounted at the bottom of the tunnel boring machine chassis 21. The high-frequency vibrating transverse drum cutter head of the second embodiment is used as the high-frequency vibrating transverse drum cutter head of this embodiment.

The tunnel boring machine chassis 21 used herein is the same as that in the prior art. The hydraulic pump may be driven by an engine or electric motor in the chassis to provide the power source. The driving arm 23 may move up and down through the lifting cylinder 25. The U-shaped drum cutter mechanism body 10 is mounted on the front end of the driving arm 23. The driving arm 23 is provided with the telescopic cylinder 22 which makes the U-shaped drum cutter mechanism body 10 take a certain telescopic motion.

During working, the tunnel boring machine chassis 21 may drive the travelling mechanism to a working position. The driving arm 23 may be lifted to a required position by the telescopic cylinder 22. Then the cutting motor 4 may be activated, and drive the transverse drum cutter wheel 16 to rotate.

The vibration motor 6 may be activated to make the vibration box 5 vibrate in high-frequency. The vibration box 5 may drive the drum cutter head base 12 to make high-speed repetitive movement.

After the rotation speed and the vibration frequency of the transverse drum cutter wheel 16 are adjusted to appropriate values, the transverse drum cutter wheel 16 may contact the object to be milled and excavated, through the operation of the telescopic cylinder 22. The cutting teeth 1 may not only cut the object, but also apply vibration impact force on the object, to break the rock instantaneously. The broken materials may be drained out to fall down to the ground through the rotation movement of the drum cutter head 2.

The collecting device 24 may collect the falling materials continuously, and transmit them to the lower part of the tunnel boring machine chassis 21 until the conveying device 20 at the back. The materials may be conveyed to a transport cart by the conveying device 20. In this way, a sequential boring operation may be formed.

The cutting motor 4 in the tunnel boring machine according to the present disclosure may be replaced with an electric motor. The drum cutter head may be driven by the electric motor through a gearbox.

According to the requirements of working conditions, the vibration box in the present invention is not limited to the above structure of eccentric vibration box, but can use a 6-eccentric wheel, 8-eccentric wheel, eccentric block or other vibration boxes of various configurations.

Preferably, a vibration box with a continuously adjustment mechanism having a eccentric moment may be used, so that the vibration box may output vibration force only when the vibration frequency of the vibration box reach a preset value, to avoid the damage of the machine caused by the machine operating within its resonance frequency range.

What is claimed is:

1. A vibrating transverse drum cutter head, comprising a transverse drum cutter wheel, a drum cutter head base, and a cutting motor, wherein the transverse drum cutter wheel is driven by the cutting motor to rotate, the transverse drum cutter wheel is provided with cutting teeth, the transverse drum cutter wheel is mounted on one end of the drum cutter head base, the other end of the drum cutter head base is connected to a U-shaped drum cutter mechanism body, a connecting base is mounted on the U-shaped drum cutter mechanism body and used for mounting the vibrating transverse drum cutter head on a drum cutter machine or a tunnel boring machine, a vibration box is mounted on the drum cutter head base, and the vibration box is adapted to output vibration force to the transverse drum cutter wheel through the drum cutter head base, so that the transverse drum cutter wheel is able to perform repetitive vibrating movement while achieving its own rotation, wherein an upper air spring which is compressible by the U-shaped drum cutter mechanism body is arranged at a top of the vibration box, and a lower air spring which is compressible by the drum cutter head base, and a first vibration reduction rubber are arranged on a lower part of the U-shaped drum cutter mechanism body.

2. The vibrating transverse drum cutter head of claim 1, wherein a middle part of the U-shaped drum cutter mechanism body is connected to the drum cutter head base through a connection bearing, or alternatively, a lateral side of the U-shaped drum cutter mechanism body is provided with a strengthening rib, the drum cutter head base is connected to the strengthening rib through a vibration reduction rubber to achieve sliding displacement, and a second vibration reduction rubber is arranged between the drum cutter head base and the U-shaped drum cutter mechanism body.

3. The vibrating transverse drum cutter head of claim 1, wherein the cutting motor is mounted on the drum cutter head base, a driving gear is mounted on an output end of the cutting motor, the driving gear is engaged with a transmission gear mounted on the drum cutter head base, and the transmission gear is engaged with a driven gear mounted on an axle of the transverse drum cutter wheel.

4. The vibrating transverse drum cutter head of claim 1, wherein a pivoting support is mounted between the U-shaped drum cutter mechanism body and the connecting base, so that the high-frequency vibrating transverse drum cutter head is pivotable about the connecting base for a certain angle.

5. A drum cutter machine with the vibrating transverse drum cutter head of claim 1, wherein the vibrating transverse drum cutter head is connected to one end of a telescopic driving arm through the connecting base, the other end of the driving arm is hinged to a mounting base of the drum cutter machine, a telescopic cylinder and a lifting cylinder are mounted on a lateral side and a lower side of the driving arm respectively, one end of each of the telescopic cylinder and the lifting cylinder is hinged to the mounting base, and the other end of each of the telescopic cylinder and the lifting cylinder is hinged to the driving arm.

6. A tunnel boring machine with the vibrating transverse drum cutter head of claim 1, wherein the vibrating transverse drum cutter head is connected to one end of a telescopic driving arm through the connecting base, the other end of the driving arm is hinged to a mounting base of the tunnel boring machine, a telescopic cylinder and a lifting cylinder are mounted on a lateral side and a lower side of the driving arm respectively, one end of each of the telescopic cylinder and the lifting cylinder is hinged to the mounting base, and the other end of each of the telescopic cylinder and the lifting cylinder is hinged to the driving arm; and the mounting base is mounted on one end of a tunnel boring machine chassis, a side-shifting mechanism is provided to control the mounting base to swing from side to side, the other end of the tunnel boring machine chassis is provided with a conveying device, a collecting device is arranged below the driving arm, mounted on the tunnel boring machine chassis, and connected to the conveying device, and a travelling mechanism is mounted at the bottom of the tunnel boring machine chassis.

* * * * *